United States Patent [19]

Rutzen et al.

[11] Patent Number: 4,913,829

[45] Date of Patent: Apr. 3, 1990

[54] AQUEOUS FABRIC SOFTENER COMPOSITION: OPTIONALLY QUATERNIZED ALIPHATIC AMINE AND SULFONIC OR PHOSPHONIC ACID COMPOUND

[75] Inventors: Horst Rutzen, Langenfeld; Eric Sung, Monheim, both of Fed. Rep. of Germany

[73] Assignee: Henkel Kommanditgesellschaft auf Aktien, Duesseldorf, Fed. Rep. of Germany

[21] Appl. No.: 272,171

[22] Filed: Nov. 16, 1988

[30] Foreign Application Priority Data

Nov. 19, 1987 [DE] Fed. Rep. of Germany .... 3739143.7

[51] Int. Cl.[4] ..... C11D 1/62; C11D 3/20; D06M 13/36

[52] U.S. Cl. ..... 252/8.75; 8/137; 252/8.8

[58] Field of Search ..... 252/8.75, 8.8; 8/137

[56] References Cited

U.S. PATENT DOCUMENTS 4,832,856 5/1989 Rutzen et al. ..... 252/8.8

FOREIGN PATENT DOCUMENTS 267551 5/1988 European Pat. Off. .
281975 9/1988 European Pat. Off. .

*Primary Examiner*—A. Lionel Clingman
*Attorney, Agent, or Firm*—Ernest G. Szoke; Wayne C. Jaeschke; Real J. Grandmaison

[57] ABSTRACT

Fabric softeners for the treatment of fabrics after washing contain as active constituents a combination of one or more sulfonic acids or phosphonic acids and amines or quaternary ammonium compounds thereof bearing a long alkyl or alkenyl radical. This combination of active constituents is readily and inexpensively obtainable and provides the treated fabrics with a soft, full feel.

21 Claims, No Drawings

AQUEOUS FABRIC SOFTENER COMPOSITION: OPTIONALLY QUATERNIZED ALIPHATIC AMINE AND SULFONIC OR PHOSPHONIC ACID COMPOUND

BACKGROUND OF THE INVENTION

1. Field of the Invention

This invention relates to softeners which may be used for the treatment of fabrics after washing.

"Fabric softeners" are normally understood to be preparations containing one or more active ingredients which may be, or are, blended in water and which are used in the detergent field to provide fabrics with a soft feel. Preparations such as these normally contain one or more cationic surfactants which are capable of making fabrics treated with them soft and fluffy. The cationic surfactants proposed include, in particular, water-insoluble quaternary ammonium compounds in which the ammonium nitrogen atom, to ensure that the softener develops adequate softening effects, must contain at least two long-chain aliphatic radicals containing from 16 to 18 carbon atoms or at least one overlong radical, for example containing from 32 to 36 carbon atoms, the long or over-long radicals optionally being interrupted by ether, ester or amido groups. Quaternary ammonium compounds such as these have been produced in large quantities, generally by expensive methods, specifically for the production of fabric softeners.

2. Discussion of Related Art

According to German Pat. No. 2,943,606, long-chain alkyl or alkenyl monocarboxylic acids are used in addition to water-insoluble cationic surfactants of the type herein in fabric softeners in order to considerably improve the softening effect of fabric softeners. However, a disadvantage of these known preparations lies in the complicated synthesis of the water-insoluble quaternary ammonium compounds mentioned.

An object of the present invention is to obviate the disadvantages of the prior art, more especially the use of softener constituents prepared by complicated syntheses, and to provide fabric softeners whose active ingredients may be produced by simple chemical syntheses from inexpensive raw materials or from intermediate products which can be synthesized on a large scale. It has surprisingly been found in this regard that fabric softeners having a good softening effect can be obtained by simple mixing of certain sulfonic acids and/or phosphonic acids and fatty amines or corresponding quaternary compounds of the fatty amines which may be inexpensively obtained on a large scale from natural raw materials by simple oleochemical syntheses.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to aqueous fabric softener compositions based on a combination of sulfonic acids or phosphonic acids and amines or quaternary ammonium compounds thereof containing a long-chain alkyl or alkenyl radical, comprising (a) one or more amines corresponding to general formulae (I) or (II)

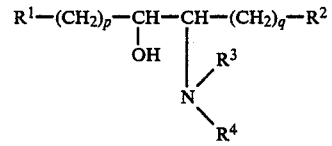

(I)

$R^1R^3R^4N$ (II)

in which $R^1$ and $R^2$ may be the same or different and, independently of one another, represent hydrogen, linear or branched $C_1$–$C_{20}$ alkyl radicals, the alkyl radicals optionally being interrupted by ether groups; in addition, in formula (II), $R^1$ may also be a group corresponding to the formula $CH_3—(CH_2)_n—CO—NH—(CH_2)_3—$ wherein n=8 to 18, in addition to which $R^2$ may also be a hydroxy group or a group corresponding to formula (III)

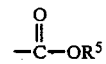

(III)

in which $R^5$ is hydrogen or a linear or branched $C_1$–$C_6$ alkyl radical, and $R^3$ and $R^4$ may be the same or different and, independently of one another, represent hydrogen, linear or branched $C_1$–$C_6$ alkyl radicals or hydroxyalkyl radicals containing 1 to 6 carbon atoms in the linear alkyl radical and p and q are numbers of 0 to 22, the sum (p+q) being from 0 to 22, or one or more ammonium compounds derived from such amines by quaternization, (b) one or more sulfonic acids corresponding to general formulae (V), (VI), (VII) and (VIII)

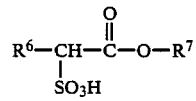

(V)

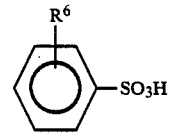

(VI)

$R^6—SO_3H$ (VII)

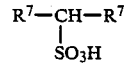

(VIII)

or one or more phosphonic acids corresponding to general formulae (IX), (X), (XI) and (XII)

$R^6—PO_3H_2$ (IX)

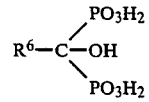

(X)

-continued $$R^6-CH_2-NH-CH_2-PO_3H_2 \quad (XI)$$

$$R^6-CH_2-N(CH_2-PO_3H_2)_2 \quad (XII)$$

in which $R^6$ represents linear or branched $C_1$–$C_{18}$ alkyl or alkenyl radicals and $R^7$ represents linear or branched $C_1$–$C_6$ alkyl radicals, and, (c) optionally other constituents typically present in fabric softeners.

Accordingly, the fabric softeners according to the invention may contain a plurality of compounds corresponding to general formulae (I) and (II) as the amine component. In addition, one or more ammonium compounds derived from amines corresponding to general formulae (I) or (II) by quaternization is/are also suitable as the "amine component" either together with or instead of the above-mentioned amines corresponding to general formulae (I) or (II).

Besides hydrogen, therefore, $R^1$ and $R^2$ independently of one another may represent linear alkyl radicals from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl and also the branched homologs of the alkyl radicals mentioned which, basically, may be used with equal advantage. The alkyl groups mentioned may be interrupted by ether groups. What this means is that it is possible to introduce into alkyl radicals, particularly relatively long alkyl radicals, oxygen atoms emanating from alkoxylation reactions of corresponding alkyl radicals or derivatives thereof. In addition, $R^1$ in general formula (II) above may be a group corresponding to the following formula $$CH_3-(CH_2)_n-CO-NH-(CH_2)_3-$$

in which the index n may have a value of from 8 to 18. Fatty acid amidoalkyl radicals such as these are thus directly attached to the amino nitrogen atom or, in the case of the ammonium compounds derived from such amines by quaternization, to the ammonium nitrogen atom. Besides the meanings mentioned, $R^2$ may also have other meanings. According to the invention, $R^2$ in the amines suitable for use in fabric softeners may also be a hydroxy group or a group corresponding to formula (III)

$$-\overset{O}{\overset{\|}{C}}-OR^5 \quad (III)$$

in which $R^5$ is hydrogen or an alkyl radical from the group consisting of methyl, ethyl, n-propyl, i-propyl, n-butyl, i-butyl, t-butyl, n-pentyl, the homologous pentyl radicals isomeric to n-pentyl, n-hexyl and the branched hexyl radicals isomeric to n-hexyl.

Besides hydrogen, $R^3$ and $R^4$ in the amines suitable for use in the fabric softeners according to the invention may also represent linear or branched $C_1$–$C_6$ alkyl radicals, i.e. radicals from the group consisting of methyl, ethyl, n-propyl, i-propyl, n-butyl, i-butyl, t-butyl, n-pentyl, n-hexyl and also the branched pentyl and hexyl radicals isomeric to the linear pentyl and hexyl radicals.

In addition, $R^3$ and $R^4$ in general formulae (I) and (II) may also be hydroxyalkyl radicals in which the alkyl groups are always linear and emanate from the group consisting of methyl, ethyl, propyl, butyl, pentyl and hexyl radicals.

In general formula (I), the indices p and q may stand for a number of 0 to 22, the sum (p+q) always being from 0 to 22. In this regard, p and q may assume any possible value within the range mentioned. This also includes fractional numbers because, as will be explained hereinafter, mixtures of compounds in which there is a different number of $-CH_2$ groups in the molecule and the indices p and q merely indicate the mean values are also used. Through the accumulation of mixtures of compounds in different proportions within a mixture, fractional numbers are thus also possible as indices for p and q. In accordance with the foregoing observations, a large number of compounds which correspond to general formulae (I) and (II) or which are derived from such compounds by quaternization are suitable as the amine component for the fabric softeners according to the invention. In preferred embodiments of the invention, the amines of general formula (I) used may be divided into several groups. Thus, one or more compounds of general formula (I) in which $R^1$ and $R^2$ are hydrogen, $R^3$ and $R^4$ independently of one another represent linear or branched $C_1$–$C_6$ alkyl radicals or hydroxyalkyl radicals containing 1 to 6 carbon atoms in the alkyl group, is preferably used as the amine component. Compounds of this class are amines which may be produced from olefines on an industrial scale via an epoxidation stage; the resulting olefin epoxides are then reacted with secondary amines corresponding to the following general formula $$R^3R^4NH$$

in accordance with reaction equation (1) below, resulting in the formation of the above-mentioned preferred amines corresponding to general formula (I) in which $R^1=R^2=H$.

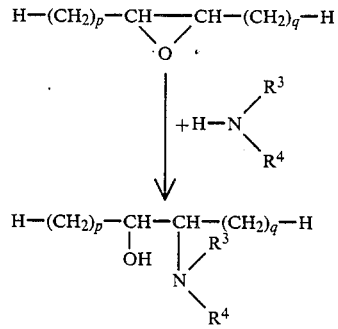

In another preferred embodiment, the fabric softeners according to the invention contain one or more amines corresponding to general formula (I) in which $R^1$ and $R^2$ represent hydrogen, $R^3$ and $R^4$ independently of one another represent linear $C_1$–$C_3$ alkyl radicals or hydroxyalkyl radicals containing 1 to 3 carbon atoms in the alkyl group and q=0 and p has a value of 8 to 18. Particularly preferred amines of general formula (I) are those in which $R^1$ and $R^2$ represent hydrogen, $R^3$ and $R^4$ independently of one another represent methyl or ethyl groups or hydroxyethyl radicals and q=0 and p has a value of 10 to 16. The particularly preferred amines in this group are obtained from $C_6$-$C_{24}$ olefin epoxides ($p=0$ to 10, $q=0$ to 12, $R^1=R^2=H$) and dimethylamine or diethylamine or methyl ethanolamine or diethanolamine in accordance with reaction equation (1) above and give amines corresponding to general formula (I) which have particularly good fabric softening properties, i.e. provide fabrics with a soft feel and pleasant fluffiness.

In another preferred embodiment, the softeners contain one or more amines corresponding to general formula (I) in which $R^1$ represents hydrogen or linear or branched $C_1$-$C_{20}$ alkyl radicals and $R^2$ is a hydroxy group or a group corresponding to formula (III)

$$-\overset{\overset{\displaystyle O}{\|}}{C}-OR^5 \qquad \text{(III)}$$

in which $R^5$ is hydrogen or a linear or branched $C_1$-$C_6$ alkyl radical. Amines such as these are formed in accordance with reaction equation (2) below from epoxidized fatty acids, fatty acid esters or fatty alcohols which may be inexpensively obtained in large quantities from animal or vegetable fats or oils, i.e. from natural sources, and which may be used not only as individual substances but also as mixtures resulting from the natural sources. Mixtures such as these include not only mixtures of compounds of different chain length of the type occurring as homologs of otherwise identical structure in natural fats and oils, but also mixtures of compounds which bear epoxide groups at different places in the molecular chain and, hence, also lead differently, through the reaction with the corresponding amines, to mixtures of ring opening products corresponding to general formula (I). The product mixtures of general formula (I) resulting from reaction equation (2) are suitable as the amine component of the fabric softeners according to the invention

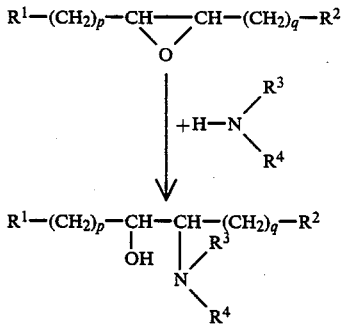

(I)

In particularly preferred embodiments, the fabric softeners contain one or more amines corresponding to general formula (I) in which $R^1$ is a linear or branched $C_1$-$C_{20}$ alkyl radical and $R^2$ is a hydroxy group or a group corresponding to formula (III).

$$-\overset{\overset{\displaystyle O}{\|}}{C}-OR^5 \qquad \text{(III)}$$

in which $R^5$ is as defined above, and $R^3$ and $R^4$ independently of one another represent linear or branched $C_1$-$C_6$ alkyl radicals or hydroxyalkyl radicals containing 1 to 6 carbon atoms in the linear alkyl group. Among such compounds corresponding to general formula (I), those in which $R^1$ is a linear $C_1$-$C_3$ alkyl group, $R^2$ is a carbonyloxymethyl group and $R^3$ and $R^4$ independently of one another represent hydrogen, linear or branched $C_1$-$C_6$ alkyl radicals or hydroxyalkyl radicals containing 1 to 6 carbon atoms in the linear alkyl group, are particularly suitable as amine components for fabric softeners according to the invention because fabric softeners containing such amine components are capable of providing the fabrics washed with them with the desired fluffiness and a soft feel. According to the invention it can also be of advantage in this regard, where $R^1$ and $R^2$ have the same meanings as mentioned above, to select the substituents $R^3$ $R^4$ in general formula (I) of the amine or amines used from the group of linear $C_1$-$C_3$ alkyl radicals and hydroxyalkyl radicals containing 1 to 3 carbon atoms in the linear alkyl group, in which case $p=8$ to 18 and $q=O$. Of these compounds, those in which $R^3$ and $R^4$ in general formula (I) represent methyl or ethyl radicals or hydorxyethyl radicals and $p=10$ to 16 and $q=0$ are particularly preferred by virtue of the particularly favorable fabric softening results obtained with them.

In addition to or instead of one or more amines corresponding to general formula (I), the fabric softeners according to the invention may also contain amines corresponding to general formula (II)

$$R^1R^3R^4N \qquad \text{(II)}$$

in which $R^1$ may be hydrogen, linear or branched $C_1$-$C_{20}$ alkyl radicals of the type mentioned above and $R^3$ and $R^4$ may be the same or different and, independently of one another, may represent hydrogen, linear or branched $C_1$-$C_6$ alkyl radicals or hydroxyalkyl radicals containing 1 to 6 carbon atoms in the linear alkyl radical. The substituent $R^1$ in general formula (II) typically contains 12 to 20 carbon atoms and preferably 14 to 18 carbon atoms. Amines having chain lengths in this preferred range may be conveniently synthesized from natural fats and oils by methods known per se. By virtue of the synthesis methods normally used, mixtures of amines of different chain length are generally obtained on an industrial scale and may readily be present as the amine component in the fabric softeners according to the invention. However, it is also possible to synthesize individual compounds and to use them as the amine component of the fabric softeners. Within the group of amines corresponding to general formula (II), laurylamine, cetylamine, lauryl dimethylamine and cetyl dimethylamine have proved to be particularly successful in practice. Where amine mixtures of natural fats or oils are used, coconut alkyl dimethylamine ($R^1=C_{12}$-$C_{18}$) or tallow alkyl dimethylamine ($R^1=C_{16}$-$C_{18}$) in particular are suitable as amine components for the fabric softeners according to the invention.

As already mentioned, one or more ammonium compounds derived from amines corresponding to general formulae (I) and (II) by quaternization may be used together with or instead of the above-mentioned amines of general formulae (I) and (II) as the amine component in another preferred embodiment of the invention. Ammonium compounds such as these may be used both as individual components and also as mixtures of several ammonium compounds. It is immaterial in this regard in which molar ratio they are mixed with the above-mentioned amines of general formulae (I) and (II) or in which molar ratios to one another they are present in the fabric softeners according to the invention. Those ammonium compounds which are derived by quaternization of the above-mentioned amines of general formulae (I) and (II) with a compound corresponding to general formula (IV)

$$(R^8)_mX \qquad (IV)$$

in which $R^8$ represents a linear or branched $C_1$–$C_4$ alkyl radical or phenalkyl radical containing 1 or 2 carbon atoms in the alkyl group, X is an acid anion and m is the valency of the acid anion X, may be used with advantage in addition to or instead of the amines corresponding to general formulae (I) or (II).

Accordingly, suitable alkyl groups $R^8$ in the quaternizing reagent are methyl, ethyl, n-propyl, i-propyl, n-butyl, i-butyl or t-butyl groups from the group of alkyl radicals or the benzyl or phenethyl radicals from the group of phenalkyl radicals. X may be the acid anion of a number of organic or inorganic acids. The chloride, bromide, methosulfate, ethosulfate and toluenesulfonate anions may normally be considered for the acid anion X.

Where ammonium compounds are used, it is of particular advantage to use those which are derived from the compounds of general formulae (I) or (II) by quaternization with a quaternizing reagent from the group consisting of methyl chloride, ethyl chloride, benzyl chloride or dimethyl sulfate.

The reaction by which the amines of general formulae (I) or (II) are quaternized with the quaternizing reagents mentioned is generally known per se and is also carried out as known from the prior art for the production of the ammonium compounds suitable for use in accordance with the invention. In other words, the particular amines are reacted with the desired quaternizing reagent at elevated temperature in the presence or absence of a solvent.

In another embodiment of the invention, it is also possible to carry out the quaternization reaction as known from the prior art by recting the particular amine with an alkylene oxide, preferably ethylene oxide, in the presence of an acid to form quaternization products which, instead of the hydrogen atom, contain a hydroxyalkyl group in the amine, the number of carbon atoms in the alkyl chain corresponding to the number of carbon atoms of the alkylene oxide used for the reaction and the statistical number of alkoxy groups being determined by the molar ratio of alkylene oxide to amine adjusted in the reaction. The quaternary ammonium compounds formed in this way contain the acid anion of the acid used in the reaction as the anion X, the anion X representing, for example, a chloride, sulfate, acetate, lactate, phosphate or benzoate anion.

The fabric softerners according to the invention, which contain one or more amines of general formula (I) or (II) or quaternary ammonium compounds derived therefrom as the amine component, comprise as another essential component one or more sulfonic acids corresponding to general formulae (V), (VI), (VII) and (VIII)

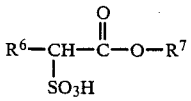

(V)

-continued

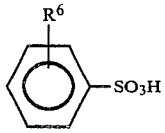

(VI)

$$R^6—SO_3H \qquad (VII)$$

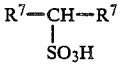

(VIII)

or one or more phosphonic acids corresponding to general formulae (IX), (X), (XI), and (XII)

$$R^6—PO_3H_2 \qquad (IX)$$

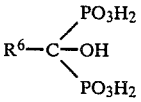

(X)

$$R^6—CH_2—NH—CH_2—PO_3H_2 \qquad (XI)$$

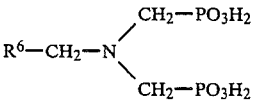

(XII)

in which $R^6$ represents linear or branched $C_1$–$C_{18}$ alkyl or alkenyl radicals and $R^7$ represents linear or branched $C_1$–$C_6$ alkyl radicals.

Accordingly, suitable sulfonic acids are individual compounds of general formula (V) or mixtures of such compounds which may be obtained by methods known per se from the prior art from fatty acid alkyl esters corresponding to general formula (XIII) and $SO_3$ in accordance with reaction equation (3) below:

Reaction equation (3)

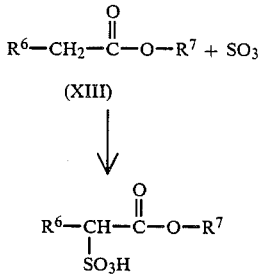

(XIII)

(V)

In practice, the starting materials used for this reaction are fatty acid esters (XIII) or mixtures of such esters which emanate from natural fats or oils and are converted by transesterification as known from the prior art into compounds corresponding to formula (XIII). However, it is also possible to use fatty acids or mixtures of fatty acids which emanate from fats or oils of natural origin and are converted into a fatty acid ester (XIII) or a mixture of such esters by reaction with an alcohol corresponding to the following general formula $$R^7OH$$

More specifically, the substituents $R_6$ in such sulfonic acids may be linear alkyl radicals from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl. Instead of the linear alkyl radical mentioned, however, it would also be possible to consider those which contain a corresponding number of carbon atoms and which are branched at one or more places in the molecule. However, linear alkyl radicals $R^6$ are preferred.

In view of the fact that natural fats or oils also contain unsaturated components, linear or branched alkenyl radicals which correspond to the alkyl radicals mentioned above and which comprise C=C bonds at one or more points of the chain may also be considered for the substituents $R^6$ in the above-mentioned sulfonic acids corresponding to general formula (V).

In general formulae (V) and (XIII) above, the substituents $R^7$ are $C_1$–$C_6$ alkyl radicals, i.e. radicals from the group consisting of methyl, ethyl, propyl, butyl, pentyl and hexyl; once again, both linear and branched radicals from this group may be considered.

In practice, the compounds corresponding to general formula (V) above are normally obtained by reacting the carboxylic acid esters of general formula (XIII), which may emanate directly from natural sources or may have been prepared therefrom by transesterification, hydrogenating hardening or similar reactions known from the prior art, with $SO_3$. This is also done by methods known from the prior art. For example, reactions of the type herein take place at a temperature in the range from 60° to 90° C. and under $SO_3$ partial pressures of 0.03 to 0.1 bar in the presence of a suitable organic solvent or in the absence of solvents. Reactions of mixtures (XIII) also lead correspondingly to mixtures of compounds corresponding to general formula (V) which, if desired, may be separated, but are normally used as such as the acid constituent for the fabric softeners according to the invention.

In another embodiment, the fabric softeners according to the invention contain one or more sulfonic acids corresponding to general formula (VI)

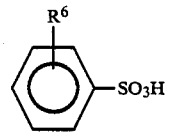

(VI)

instead of or in addition to the compounds of general formula (V). In formula (VI), $R^6$ is as already defined for the sulfonic acids of general formula (V). The alkyl radicals or alkenyl radicals $R^6$ may be situated at any position of the aromatic ring.

From the large group of above-mentioned compounds corresponding to general formulae (V) and (VI), one or more compounds in which $R^6$ represents a linear $C_{12}$–$C_{16}$ alkyl radical or $R^7$ represents methyl or ethyl is present in the fabric softeners in particularly preferred embodiments of the invention. Sulfonic acids or sulfonic acid mixtures of compounds from the group consisting of hydropalm kernel oil fatty acid methyl ester sulfonic acid, hydrotallow fatty acid methyl ester sulfonic acid, dodecyl benzenesulfonic acid and p-toluenesulfonic acid have proved to be particularly successful. The term "Hydropalm kernel oil fatty acid methyl ester sulfonic acid" is understood to be a class of compounds which can be obtained in accordance with the above reaction equation from palm kernel oils by transesterification with methanol and hydrogenation of the unsaturated alkyl radicals, followed by reaction with $SO_3$. Similarly, "hydrotallow fatty acid methyl ester sulfonic acid" is understood to be a class of compounds which are obtained from tallow by transesterification and hydrogenation of the unsaturated constituents, followed by reaction with $SO_3$.

In another embodiment of the invention, the fabric softeners contain one or more acids corresponding to general formulae (VII) and (VIII)

$$R^6-SO_3H \quad \text{(VII)}$$

$$R^7-\underset{\underset{SO_3H}{|}}{CH}-R^7 \quad \text{(VIII)}$$

instead of or in addition to the compounds corresponding to general formulae (V) or (VI). In these long-chain alkyl sulfonic acids (VII) and alkanesulfonic acids (VIII), the substituents $R^6$ and $R^7$ may have the meanings already defined above in connection with the sulfonic acids (V) and (VI). Alkyl radicals $R^6$ which contain 12 to 16 carbon atoms or $R^7$ which represents methyl or ethyl are also preferred in this connection.

One or more phosphonic acids corresponding to general formula (IX)

$$R^6-PO_3H_2 \quad \text{(IX)}$$

may advantageously be present in the fabric softeners according to the invention instead of or together with the sulfonic acids corresponding to general formulae (V) and (VI). In general formula (IX), $R^6$ has the meanings already defined above in connection with general formulae (V) and (VI). Compounds (IX) in which $R^6$ represents linear $C_{12}$–$C_{16}$ alkyl radicals are particularly preferred. Tetradecyl-1-phosphonic acid has proved to be a particularly successful phosphonic acid component in the fabric softeners according to the invention.

The fabric softeners according to the invention may also contain other phosphonic acids corresponding to general formulae (X), (XI) and (XII)

$$R^6-C(PO_3H_2)_2-OH \quad \text{(X)}$$

$$R^6-CH_2-NH-CH_2-PO_3H_2 \quad \text{(XI)}$$

$$R^6-CH_2-N(CH_2-PO_3H_2)_2 \quad \text{(XIII)}$$

instead of or together with the sulfonic acids corresponding to general formulae (V) to (VIII) above or the phosphonic acids corresponding to general formula (IX). In general formulae (X), (XI) and (XII), the substituents $R^6$ are again linear or branched alkyl radicals or alkenyl radicals containing 1 to 18 carbon atoms while the substituents $R^7$ are linear or branched $C_1$–$C_6$ alkyl radicals. As already defined for the sulfonic acids mentioned above, linear $C_{12}$–$C_{16}$ alkyl radicals are preferred for the radicals $R^6$ while methyl radicals or ethyl radicals are preferred for the radicals $R^7$.

The fabric softeners according to the invention normally contain the components mentioned, i.e. amines corresponding to general formulae (I) or (II) or quaternary ammonium compounds derived therefrom by quaternization on the one hand and sulfonic acids corresponding to general formulae (V) and (VIII) or phosphonic acids corresponding to general formulae (IX) to (XII) on the other hand in certain quantitites. The quantity of amine component is normally in the range from 10 to 90 mol-%., while the quantities of sulfonic acids or phosphonic acids are normally in the range from 90 to 10 mol-%. A molar ratio of main components to acid components of from 0.75:1 to 4:1 and more especially of 1:1 is particularly preferred.

The fabric softeners according to the invention contain water as a further component. The water is present in the fabric softeners in a quantity which adds up to 100% by weight with the quantities of the amine component and of the sulfonic or phosphonic acid component and with the other conventional constituents present, if any.

In addition to the three essential components mentioned (amine component, sulfonic acid or phosphonic acid component and water), the fabric softeners may optionally contain other ingredients of the type typically used in fabric softeners, including for example perfumes, colorants, solvents, preservatives and viscosity regulators. Such constituents are normally present in the fabric softeners in quantities of 0 to 50% by weight, based on the total weight of the fabric softener. However, their presence or absence does not affect the softening result.

The fabric softeners according to the invention containing the amine component, sulfonic acid or phosphonic acid component and, optionally, other constituents are blended on an aqueous basis. The quantities of water used are adjusted in such a way that easy-to-handle, low viscosity fabric softeners are formed by blending in this way and may readily be introduced into the final rinse water in this form. The quantity of water in the blended fabric softeners according to the invention is normally in the range from about 98 to about 50% by weight.

The fabric softeners according to the invention are prepared by processes known from the prior art. Such processes essentially comprise mixing the individual components with one another in standard commercially available mixers. This is done if desired in the presence of a solvent and/or at slightly elevated temperature. The solvents suitable for the production of the fabric softeners are best selected so that they may remain in the blended fabric softener. Examples of suitable solvents include ethanol, n-propanol, i-propanol, ethylene glycol, propylene glycol, diglycols and polyglycols. Suitable concentrations are mainly dependent on the particular case, i.e., the miscibility of the amine component and carboxylic acid component with water, and may be selected within wide limits. One important criterion for the choice of the type and quantity of solvent used in the production of the fabric softeners is its compatibility with water.

The fabric softeners according to the invention obtained in this way are substantially soluble or finely dispersible in aqueous phase and thus show particularly high stability in storage. For practical application, they are used in liquors, normally in concentrations of 0.1 to 0.6 g/1, based on the amine and sulfonic acid or phosphonic acid component, and show the desired softening result in this concentration range. They provide the fabrics washed with them with good fluffiness and a soft feel which was found by examiners to be extremely pleasant. The essential components used for the production of the fabric softeners according to the invention may be conveniently obtained on an industrial scale from inexpensively available, in some cases, natural sources. The individual components do not have to be separated or purified for the production of the fabric softeners according to the invention.

The invention is illustrated by the following examples.

EXAMPLES 1 to 6

Fabric softeners according to the invention were prepared using the components shown in Table 1 below. To this end, the acid component and the amine component were reacted with one another in a molar ratio of 1:1 with occasional stirring and with heating on a steam bath to about 80° C.

The active-substance combinations used for the fabric softeners of Examples 1 to 6 are shown in Table 1 below.

TABLE 1

| | Fabric softeners according to the invention | | |
|---|---|---|---|
| Example | Formula of amine component | Formula of acid component | Molar Ratio |
| 1 | II; $R^1$ = n-$C_{16}H_{33}$; $R^3 = R^4 = CH_3$; quaternized with $CH_3Cl$[1] | V; $R^6 = C_{10-16}H_{21-33}$; $R^7 = CH_3$ | 1:1 |
| 2 | II; $R^1$ = n-$C_{16}H_{33}$; $R^3 = R^4 = CH_3$ | V; $R^6 = C_{10-16}H_{21-33}$; $R^7 = CH_3$ | 1:1 |
| 3 | II; $R^1 = CH_2CH_2OH$; $R^3 = R^4 = CH_3$ | V; $R^6 = C_{10-16}H_{21-33}$; $R^7 = CH_3$ | 1:1 |
| 4 | II; $R^1$ = n-$C_{16}H_{33}$; $R^3 = R^4 = CH_3$ | V; $R^6 = C_{14-16}H_{29-33}$; $R^7 = CH_3$ | 1:1 |
| 5 | II; $R^1$ = n-$C_{16}H_{33}$; $R^3 = R^4 = CH_3$ | VI; $R^6 = C_{12}H_{25}$ | 1:1 |
| 6 | II; $R^1$ = n-$C_{16}H_{33}$; $R^3 = R^4 = CH_3$ | VI; $R^6 = CH_3$ | 1:1 |

[1]Commerically available as "Dehyquart A"

EXAMPLE 7

Tetradecyl-1-phosphonic acid and dimethyl hexadecyl-amine were reacted in a molar ratio of 1:1 at about 80° C. in the same way as in Examples 1 to 6 above.

EXAMPLE 8

To test their fabric softening properties, the mixtures obtained in accordance with Examples 1 to 7 were dispersed in water. The active-substance concentration of the fabric softeners according to the invention was 0.3 g/1 water.

Cotton terry fabric, which had been previously treated for 96 hours with a solution of 4 g of sodium tripolyphosphate per liter of water and which was very hot, was contacted with the dispersions for 5 minutes. The treatment liquid was then separated off by centrifugation (10 seconds).

After drying, the terry samples were tested for softness by comparison with the hard starting material by examiners experienced in the softiness evaluation of fabrics. Testing was based on an evaluation scale of 0 (very hard feel) to 6 (very soft feel).

In a "double assessment", two fabric samples were each treated with the fabric softener to be tested; similarly, in a "triple assessment", three fabric samples were each treated and tested.

The results are shown in Table 2 below.

EXAMPLE 9

For further testing and evaluation of the fabric softeners according to the invention, molleton cloths were treated for 20 hours with an aqueous sodium tripolyphosphate solution in the same way as described in Example 8. The fabrics were then extremely hard. Sensory evaluation was carried out in the same way as described in Example 8. The results are again shown in Table 2 below.

EXAMPLE 10

For further evaluation of the softening properties of the softeners according to the invention, prewashed terry samples which had not been treated with sodium tripolyphosphate were treated with the fabric softeners according to the invention and then subjected to the sensory test described in Examples 8 and 9. The results are again shown in Table 2 below.

TABLE 2

Results of the softiness evaluation of fabrics treated with the fabric softeners according to the invention.

| Softener of example no. | FEEL MARKS Hardened terry (Example 8) | Hardened molleton (Example 9) | Prewashed terry (Example 10) | X(1) |
|---|---|---|---|---|
| 1 | 4.1 | 3.8 | 4.0 | 3.9 |
| 2 | 4.4 | 4.5 | 4.6 | 4.5 |
| 3 | 2.1 | 1.6 | 1.6 | 1.7 |
| 4 | 4.6 | 4.8 | 3.5 | 4.3 |
| 5 | 4.0 | 4.3 | 3.8 | 4.0 |
| 6 | 3.5 | 4.2 | 3.8 | 3.8 |
| 7 | 4.5 | 4.5 | 4.2 | 4.4 |

(1)Mean value of the three evaluations

Result

As shown by the results of the sensory test, which are averaged over all measurements in Table 2, column 5, the treated fabrics show very good fluffiness and considerable softiness after drying. In addition, the absorption capacity of the treated fabrics was no different after drying from that of untreated fabrics.

We claim:

1. An aqueous fabric softener composition based on a combination of acids and amines or quaternary ammonium compounds thereof bearing a long-chain alkyl or alkenyl radical, comprising (a) one or more amines corresponding to formula (I) or (II)

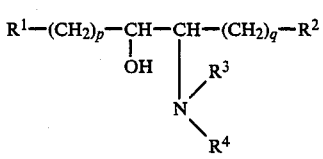

(I)

$R^1R^3R^4N$ (II)

wherein in formula (I)

$R^1$ and $R^2$ may be the same or different and, independently of one another, represent hydrogen, a linear or branched $C_1$–$C_{20}$ alkyl radical, and wherein the alkyl radical may be interrupted by ether groups, and $R^2$ may also be a hydroxy group or a group corresponding to formula (III)

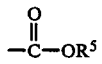

(III)

in which $R^5$ is hydrogen, or a linear or branched $C_1$–$C_6$ alkyl radical; in formula (II), $R^1$ may represent hydrogen, a linear or branched $C_1$–$C_{20}$ alkyl radical wherein the alkyl radical may be interrupted by ether groups, or a group corresponding to the following formula $CH_3$—$(CH_2)_n$—CO—NH—$(CH_2)_3$ wherein n=8 to 18, and $R^3$ and $R^4$ may be the same or different and, independently of one another, represent hydrogen, a linear or branched $C_1$–$C_6$ alkyl radical or hydroxyalkyl radical containing 1 to 6 carbon atoms in the linear alkyl radical, and in formula (I)

p and q have a value of 0 to 22, the sum (p+q) being from 0 to 22, or one or more ammonium compounds derived from said amines by quaternization, (b) one or more sulfonic acids corresponding to formulae (V), (VI), (VII) and (VIII)

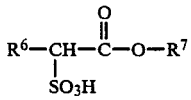

(V)

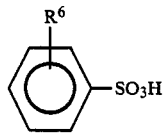

(VI)

$R^6$—$SO_3H$ (VII)

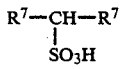

(VIII)

or one or more phosphonic acids corresponding to formulae (IX), (X), (XI) and (XII)

$R^6$—$PO_3H_2$ (IX)

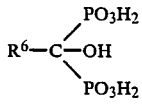

(X)

$R^6$—$CH_2$—NH—$CH_2$—$PO_3H_2$ (XI)

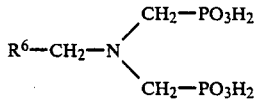

(XII)

in which $R^6$ represents a linear or branched alkyl or alkenyl radical containing 1 to 18 carbon atoms and $R^7$ represents a linear or branched $C_1$–$C_6$ alkyl radical, and (c) other constitutents typically present in a fabric softener composition selected from perfumes, colorants, solvents, preservatives and viscosity regulators.

2. A fabric softener composition as in claim 1 containing component (a) in a quantity of about 10 to about 90 mol-%, component (b) in a quantity of about 90 to about 10 mol-%, component (c) in a quantity of 0 to about 50% by weight, based on the total weight of the fabric softener composition, and water in a quantity which balances the total quantity of all the components to 100% by weight.

3. A fabric softener composition as in claim 1 containing one or more amines corresponding to formula (I) in which $R^1$ and $R^2$ represent hydrogen, $R^3$ and $R^4$ represent a linear $C_1$–$C_3$ alkyl radical or hydroxyalkyl radical containing 1 to 3 carbon atoms in the linear alkyl radical and p=8 to 18 and q=0.

4. A fabric softener composition as in claim 3 containing one or more amines corresponding to formula (I) in which $R^3$ and $R^4$ represent a methyl or ethyl radical or a hydroxyethyl radical and p is a number of 10 to 16.

5. A fabric softener composition as in claim 1 containing one or more amines corresponding to formula (I) in which $R^1$ is a linear $C_1$–$C_3$ alkyl radical and $R^2$ is a carbonyloxymethyl group.

6. A fabric softener composition as in claim 5 containing one or more amines corresponding to formula (I) in which $R^3$ and $R^4$ represent a linear $C_1$–$C_3$ alkyl radical or hydroxyalkyl radical containing 1 to 3 carbon atoms in the linear alkyl group and q=0 and p is a number of 8 to 18.

7. A fabric softener composition as in claim 5 containing one or more amines corresponding to formula (I) in which $R^3$ and $R^4$ independently of one another represent a methyl or ethyl radical or hydroxyethyl radical and p is a number of 10 to 16.

8. A fabric softener composition as in claim 1 containing one or more amines corresponding to formula (II)

$$R^1R^3R^4N \qquad \text{(II)}$$

in which $R^1$ is an alkyl radical containing 12 to 20 carbon atoms.

9. A fabric softener composition as in claim 1 containing one or more ammonium compounds derived from amines of formula (I) or (II) by quaternization with a compound corresponding to formula (IV)

$$(R^8)_mX \qquad \text{(IV)}$$

in which $R^8$ represents a linear or branched $C_1$–$C_4$ alkyl radical or phenalkyl radical containing 1 to 2 carbon atoms in the alkyl radical, X is an acid anion, and m is the valency of the acid anion X, in addition to or instead of the amines corresponding to formula (I) or (II).

10. A fabric softener composition as in claim 9 containing one or more quaternary ammonium compounds derived from amines corresponding to formula (I) or (II) obtained by quaternization with a compound selected from the group consisting of methyl chooride, ethyl chloride, benzyl chloride and dimethyl sulfate.

11. A fabric softener composition as in claim 1 containing one or more sulfonic acids corresponding to formula (V) or (VI) in which $R^6$ represents a linear $C_{12}$–$C_{16}$ alkyl radical and $R^7$ is methyl or ethyl.

12. A fabric softener composition as in claim 11 containing one or more acids selected from the group consisting of hydropalm kernel oil fatty acid methyl ester sulfonic acid, hydrotallow fatty acid methyl ester sulfonic acid, dodecylbenzenesulfonic acid, and p-toluenesulfonic acid.

13. A fabric softener composition as in claim 1 containing one or more phosphonic acids corresponding to formula (IX) in which $R^6$ represents a linear $C_{12}$–$C_{16}$ alkyl radical.

14. A fabric softener composition as in claim 13 containing tetradecyl-1-phosphonic acid.

15. A fabric softener composition as in claim 1 containing one or more amines or ammonium compounds thereof and one or more sulfonic acids or phosphonic acids in a molar ratio of 0.75 to 4:1.

16. A process of softening a fabric comprising contacting said fabric with an aqueous fabric softener composition based on a combination of acids and amines or quaternary ammonium compounds thereof bearing a long-chain alkyl or alkenyl radical, comprising (a) one or more amines corresponding to formula (I) or (II)

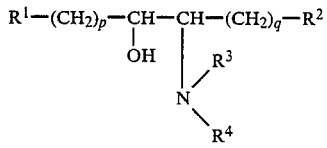

(I)

$$R^1R^3R^4N \qquad \text{(II)}$$

wherein in formula (I)

$R^1$ and $R^2$ may be the same or different and, independently of one another, represent hydrogen, a linear or branched $C_1$–$C_{20}$ alkyl radical, and wherein the alkyl radical may be interrupted by ether groups, and $R^2$ may also be a hydroxy group or a group corresponding to formula (III)

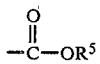

(III)

in which $R^5$ is hydrogen, or a linear or branched $C_1$–$C_6$ alkyl radical; in formula (II), $R^1$ may represent hydrogen, a linear or branched $C_1$–$C_{20}$ alkyl radical wherein the alkyl radical may be interrupted by ether groups, or a group corresponding to the following formula $$CH_3-(CH_2)_n-CO-NH-(CH_2)_3$$

wherein n=8 to 18, and $R^3$ and $R^4$ may be the same or different and, independently of one another, represent hydrogen, a linear or branched $C_1$–$C_6$ alkyl radical or hydroxyalkyl radical containing 1 to 6 carbon atoms in the linear alkyl radical, and in formula (I)

p and q have a value of 0 to 22, the sum (p+q) being from 0 to 22, or one or more ammonium compounds derived from said amines by quaternization, (b) one or more sulfonic acids corresponding to formulae (V), (VI), (VII) and (VIII)

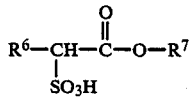

(V)

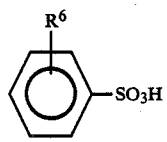

(VI)

$R^6—SO_3H$ (VII)

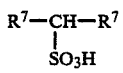

(VIII)

or one or more phosphonic acids corresponding to formulae (IX), (X), (XI) and (XII)

$R^6—PO_3H_2$ (IX)

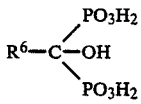

(X)

$R^6—CH_2—NH—CH_2—PO_3H_2$ (XI)

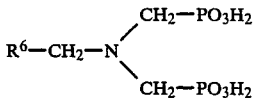

(XII)

in which $R^6$ represents a linear or branched alkyl or alkenyl radical containing 1 to 18 carbon atoms and $R^7$ represents a linear or branched $C_1$–$C_6$ alkyl radical, and (c) other constituents typically present in a fabric softener composition selected from perfumes, colorants, solvents, preservatives and viscosity regulators.

17. A process as in claim 16 wherein said composition contains component (a) in a quantity of about 10 to about 90 mol-%, component (b) in a quantity of about 90 to about 10 mol-%, component (c) in a quantity of 0 to about 50% by weight, based on the total weight of the fabric softener composition, and water in a quantity which balances the total quantity of all the components to 100% by weight.

18. A process as in claim 16 wherein said composition contains one or more ammonium compounds derived from amines or formula (I) or (II) by quaternization with a compound corresponding to formula (IV)

$(R^8)_mX$ (IV)

in which $R^8$ represents a linear or branched $C_1$–$C_4$ alkyl radical or phenalkyl radical containing 1 or 2 carbon atoms in the alkyl radical, X is an acid anion, and m is the valency of the acid anion X, in addition to or instead of the amines corresponding to formula (I) or (II).

19. A process as in claim 16 wherein said composition contains one or more sulfonic acids corresponding to formula (V) or (VI) in which $R^6$ represents a linear $C_{12}$–$C_{16}$ alkyl radical and $R^7$ is methyl or ethyl.

20. A process as in claim 19 wherein said composition contains one or more acids selected from the group consisting of hydropalm kernel oil fatty acid methyl ester sulfonic acid, hydrotallow fatty acid methyl ester sulfonic acid, dodecylbenzenesulfonic acid, and p-toluenesulfonic acid.

21. A process as in claim 16 wherein said composition contains one or more phosphonic acids corresponding to formula (IX) in which $R^6$ represents a linear $C_{12}$–$C_{16}$ alkyl radical.

* * * * *